US007807074B2

(12) United States Patent
Luly et al.

(10) Patent No.: US 7,807,074 B2
(45) Date of Patent: Oct. 5, 2010

(54) GASEOUS DIELECTRICS WITH LOW GLOBAL WARMING POTENTIALS

(75) Inventors: Matthew H. Luly, Hamburg, NY (US); Robert G. Richard, Hamburg, NY (US)

(73) Assignee: Honeywell International Inc., Morristown, NJ (US)

( * ) Notice: Subject to any disclaimer, the term of this patent is extended or adjusted under 35 U.S.C. 154(b) by 803 days.

(21) Appl. No.: 11/637,657

(22) Filed: Dec. 12, 2006

(65) Prior Publication Data

US 2008/0135817 A1 Jun. 12, 2008

(51) Int. Cl.
*H01B 3/16* (2006.01)

(52) U.S. Cl. ..... 252/571; 252/67; 252/68; 252/69

(58) Field of Classification Search ..... 252/67, 252/68, 69, 571

See application file for complete search history.

(56) References Cited

U.S. PATENT DOCUMENTS

| | | | | |
|---|---|---|---|---|
| 2,786,804 | A * | 3/1957 | Nelson | 203/50 |
| 4,257,905 | A | 3/1981 | Christophorou et al. | |
| 4,275,260 | A | 6/1981 | Wootton | |
| 4,288,651 | A | 9/1981 | Wootton | |
| 4,440,971 | A | 4/1984 | Harrold | |
| 4,547,316 | A | 10/1985 | Yamauchi | |
| 4,816,624 | A | 3/1989 | Perrissin et al. | 200/148 B |
| 4,871,680 | A * | 10/1989 | Barraud et al. | 436/103 |
| 5,236,611 | A | 8/1993 | Shiflett | |
| 5,918,140 | A * | 6/1999 | Wickboldt et al. | 438/535 |
| 6,886,573 | B2 | 5/2005 | Hobbs et al. | 134/22.1 |
| 6,897,396 | B2 | 5/2005 | Ito et al. | 218/120 |
| 2002/0135029 | A1* | 9/2002 | Ping et al. | 257/401 |
| 2002/0137269 | A1* | 9/2002 | Ping et al. | 438/197 |
| 2003/0164513 | A1* | 9/2003 | Ping et al. | 257/288 |
| 2005/0181621 | A1* | 8/2005 | Borland et al. | 438/752 |
| 2006/0060818 | A1* | 3/2006 | Tempel et al. | 252/181.3 |
| 2006/0133986 | A1* | 6/2006 | Dukhedin-Lalla et al. | 423/500 |
| 2009/0211449 | A1* | 8/2009 | Olschimke et al. | 95/233 |

FOREIGN PATENT DOCUMENTS

| | | |
|---|---|---|
| EP | 0129200 A | 12/1984 |
| EP | 1146522 X | 10/2001 |

OTHER PUBLICATIONS

CAS Reg. No. 7647-19-0, Nov. 16, 1984.*

Takuma, et al., "*Gases as a Dielectric*", pp. 195-2004, Gaseous Dielectrics X, Springer, 2004.

Lutz Niemeyer, "*A Systematic Search for Insulation Gases and Their Environmental Evaluation*"; pp. 459-464, Gaseous Dielectrics VIII, 1998.

Christophorou, et al., "*Gases for Electrical Insulation and Arc Interruption: Possible Present and Future Alternatives to Purse SF6*", NIST Technical Note 1425, Nov. 1997.

Shiojiri, et al., Abstract of "*Life cycle impact assessment of various treatment scenarios for sulfur hexafluoride (SF6) used as an insulating gas*", Environmental Progress, 2006, 25(3), 218-227.

Shiojiri, et al., Abstract of "*A Life cycle impact assessment study on sulfur hexafluoride (SF6) used as a gas insulator*", 2004, American Institute of Chemical Engineers, 005E/1-005E/9.

Goshima, et al., Abstract of "*Estimation of cross-sectional size of gas-insulated apparatus using hybrid insulation system with SF6 substitute*", Gaseous Dielectrics X, 2004, pp. 253-258.

Telfer, et al., Abstract of "*A novel approach to power circuit breaker design for replacement of SF6*", Centre for Intelligent Monitoring Systems, Dept. of Electrical Engineering and Electronics, 2004, 44(2), pp. 72-76.

Gustavino, et al., Abstract of "*Performance of glass RPC operated in streamer mode with four-fold gas mixtures containing SF6*", Nuclear Instruments & Methods in Physics Research, Section A: Accelerators, Spectrometers, Detectors, and Associated Equipment, 2004, 517(1-3), pp. 101-108.

Diaz, et al., Abstract of "*Effect of the percentage of SF6 (100%-10%-5%) on the decomposition of SF6-N2 mixtures under negative dc coronas in the presence of water vapour or oxygen*", Journal of Physics D: Applied Physics, 2003, 36(13), pp. 1558-1564.

Yanabu, et al., Abstract of "*New concept of switchgear for replacing SF6 or gas mixture*", Gaseous Dielectrics IX, 9th, 2001, pp. 497-504.

Knobloch, et al., Abstract of "*The comparison of arc-extinguishing capability of sulfur hexafluoride (SF6) with alternative gases in high-voltage circuit-breakers*", Gaseous Dielectrics VIII, 8th, 1998, pp. 565-571.

Tioursi, et al., Abstract of "*Conditioning phenomena in N2, SF6, and air*", IEE Conference, 467 (High Voltage Engineering, vol. 3), 1999, pp. 3.212-3.215.

Christophorou, et al., Abstract of "*SF6/N2 mixtures. Basic and HV insulation properties*", IEEE Transactions on Dielectrics and Electrical Insulation, 1995, 2(5), pp. 952-1003.

Pai, et al., Abstract of "*Impulse breakdown of cis-octafluorobutene/sulfur hexafluoride and cis-octafluorobutene/sulfur hexaflouride/nitrogen*", Gaseous Dielectr. Proc. Int. Sump., 2nd, 1980, pp. 190-199.

Devins, J.C., Abstract of "*Replacement gases for sulfur hexafluoride*", IEEE Transactions on Electrical Insulation, 1980, EI-15-(2), pp. 81-86.

Devins, et al., Abstract of "*Replacement gases for sulfur hexafluoride*", Annual Report—Conference on Electrical Insulation and Dielectric Phenomena, 1979, pp. 398-408.

Rhodes, et al., Abstract of "*Assessment of the possible use of polythene/gas dielectrics in high-voltage cables*", Proc. Inst. Elec. Engrs., 1965, 112-*), pp. 1617-1624.

Howard, et al., Abstract of "*Insulation properties of compressed electronegative gases*", Proc. Inst. Elec. Engrs., 1957, 104(Pt. A), pp. 123-138.

* cited by examiner

*Primary Examiner*—Douglas Mc Ginty

(57) ABSTRACT

A dielectric gaseous compound which exhibits the following properties: a boiling point in the range between about −20° C. to about −273° C.; low ozone depleting; a GWP less than about 22,200; chemical stability, as measured by a negative standard enthalpy of formation (dHf<0); a toxicity level such that when the dielectric gas leaks, the effective diluted concentration does not exceed its PEL; and a dielectric strength greater than air.

2 Claims, No Drawings

GASEOUS DIELECTRICS WITH LOW GLOBAL WARMING POTENTIALS

FIELD

The present disclosure relates generally to a class of gaseous dielectric compounds having low global warming potentials (GWP). In particular, such gaseous dielectric compounds exhibits the following properties: a boiling point in the range between about −20° C. to about −273° C.; low, preferably non-ozone depleting; a GWP less than about 22,200; chemical stability, as measured by a negative standard enthalpy of formation (dHf<0); a toxicity level such that when the dielectric gas leaks, the effective diluted concentration does not exceed its PEL, e.g., a PEL greater than about 0.3 ppm by volume (i.e., an Occupational Exposure Limit (OEL or TLV) of greater than about 0.3 ppm); and a dielectric strength greater than air. These gaseous dielectric compounds are particularly useful as insulating-gases for use with electrical equipment, such as gas-insulated circuit breakers and current-interruption equipment, gas-insulated transmission lines, gas-insulated transformers, or gas-insulated substations.

BACKGROUND

Sulfur hexafluoride ($SF_6$) has been used as a gaseous dielectric (insulator) in high voltage equipment since the 1950s. It is now known that SF6 is a potent greenhouse warming gas with one of the highest global warming potentials (GWP) known. Because of its high GWP, it is being phased out of all frivolous applications. However, there is currently no known substitute for $SF_6$ in high voltage equipment. The electrical industry has taken steps to reduce the leak rates of equipment, monitor usage, increase recycling, and reduce emissions to the atmosphere. However, it would still be advantageous to find a substitute for $SF_6$ in electrical dielectric applications.

The basic physical and chemical properties of $SF_6$, its behavior in various types of gas discharges, and its uses by the electric power industry have been broadly investigated.

In its normal state, $SF_6$ is chemically inert, non-toxic, non-flammable, non-explosive, and thermally stable (it does not decompose in the gas phase at temperatures less than 500° C.). $SF_6$ exhibits many properties that make it suitable for equipment utilized in the transmission and distribution of electric power. It is a strong electronegative (electron attaching) gas both at room temperature and at temperatures well above ambient, which principally accounts for its high dielectric strength and good arc-interruption properties. The breakdown voltage of $SF_6$ is nearly three times higher than air at atmospheric pressure. Furthermore, it has good heat transfer properties and it readily reforms itself when dissociated under high gas-pressure conditions in an electrical discharge or an arc (i.e., it has a fast recovery and it is self-healing). Most of its stable decomposition byproducts do not significantly degrade its dielectric strength and are removable by filtering. It produces no polymerization, carbon, or other conductive deposits during arcing, and its is chemically compatible with most solid insulating and conducting materials used in electrical equipment at temperatures up to about 200° C.

Besides it good insulating and heat transfer properties, $SF_6$ has a relatively high pressure when contained at room temperature. The pressure required to liquefy $SF_6$ at 21° C. is about 2100 kPa; its boiling point is reasonably low, −63.8° C., which allows pressures of 400 kPa to 600 kPa (4 to 6 atmospheres) to be employed in $SF_6$-insulated equipment. It is easily liquefied under pressure at room temperature allowing for compact storage in gas cylinders. It presents no handling problems, is readily available, and reasonably inexpensive.

$SF_6$ replaced air as a dielectric in gas insulated equipment based on characteristics such as insulation ability, boiling point, compressibility, chemical stability and non-toxicity. They have found that pure $SF_6$, or $SF_6$-nitrogen mixtures are the best gases to date.

However, $SF_6$ has some undesirable properties: it can form highly toxic and corrosive compounds when subjected to electrical discharges (e.g., $S_2F_{10}$, $SOF_2$); non-polar contaminants (e.g., air, $CF_4$) are not easily removed from it; its breakdown voltage is sensitive to water vapor, conducting particles, and conductor surface roughness; and it exhibits non-ideal gas behavior at the lowest temperatures that can be encountered in the environment, i.e., in cold climatic conditions (about −50° C.), $SF_6$ becomes partially liquefied at normal operating pressures (400 kPa to 500 kPa). $SF_6$ is also an efficient infrared (IR) absorber and due to its chemical inertness, is not rapidly removed from the earth's atmosphere. Both of these latter properties make $SF_6$ a potent greenhouse gas, although due to its chemical inertness (and the absence of chlorine and bromine atoms in the $SF_6$ molecule) it is benign with regard to stratospheric ozone depletion.

That is, greenhouse gases are atmospheric gases which absorb a portion of the infrared radiation emitted by the earth and return it to earth by emitting it back. Potent greenhouse gases have strong infrared absorption in the wavelength range from approximately 7 μm to 13 μm. They occur both naturally in the environment (e.g., $H_2O$, $CO_2$, $CH_4$, $N_2O$) and as man-made gases that may be released (e.g., $SF_6$; perfluorinated compound (PFC); combustion products such as $CO_2$, nitrogen, and sulfur oxides). The effective trapping of long-wavelength infrared radiation from the earth by the naturally occurring greenhouse gases, and its reradiation back to earth, results in an increase of the average temperature of the earth's surface. Mans impact on climate change is an environmental issue that has prompted the implementation of the Kyoto Protocol regulating the emissions of man made greenhouse gases in a number of countries.

$SF_6$ is an efficient absorber of infrared radiation, particularly at wavelengths near 10.5 μm. Additionally, unlike most other naturally occurring green house gases (e.g., $CO_2$, $CH_4$), $SF_6$ is only slowly decomposed; therefore its contribution to global warming is expected to be cumulative and long lasting. The strong infrared absorption of $SF_6$ and its long lifetime in the environment are the reasons for its extremely high global warming potential which for a 100-year time horizon is estimated to be approximately 22,200 times greater (per unit mass) than that of $CO_2$, the predominant contributor to the greenhouse effect. The concern about the presence of $SF_6$ in the environment derives exclusively from this very high value of its potency as a greenhouse gas.

Accordingly, many in the electrical equipment industry have spent substantial time and effort seeking suitable replacement gases to reduce the use of $SF_6$ in high voltage electrical equipment. To date, the possible replacement gases have been identified as (i) mixtures of $SF_6$ and nitrogen for which a large amount of research results are available; (ii) gases and mixtures (e.g., pure nitrogen, low concentrations of $SF_6$ in $N_2$, and $SF_6$—He mixtures) for which a smaller yet significant amount of data is available; and (iii) potential gases for which little experimental data is available.

Some replacements which have been proposed have higher GWPs than $SF_6$. For example, $CF_3SF_5$ falls into this category.

Because of fugitive emissions in the manufacture, transportation, filling and use of such chemicals, they should be avoided.

However, the present inventors have determined that given the environmental difficulty of $SF_6$, it is necessary to relax certain of the requirements traditionally held as important and accept as an alternative gas, compromise candidates with a lower GWP. For example, gases which are non-toxic are often inert with long atmospheric lifetimes which can yield high GWP. By accepting a somewhat more reactive gas than $SF_6$, the GWP can be greatly reduced. It may also be necessary to accept slightly more toxic materials in order to find the best alternative in these applications. Such an increase in toxicity can be offset by reducing equipment leak rates or installing monitoring equipment. In some cases, the gases discovered by the present inventors as suitable alternatives to $SF_6$ are show to be efficient at low levels and can be mixed with nitrogen and/or another non-toxic gas to give dielectrics with greatly reduced toxicity and acceptably low GWPs.

The unique gaseous compounds discovered by the present inventors for use as substitutes for $SF_6$ can be used in some existing electrical equipment, although they would preferably be used in specific electrical equipment optimized for them. The gaseous compounds of the present disclosure are preferably used in pure form, but can also be used as part of an azeotrope, or a mixture with an appropriate second gas, such as nitrogen, $CO_2$ or $N_2O$.

SUMMARY

A dielectric gaseous compound which exhibits the following properties: a boiling point in the range between about −20° C. to about −273° C.; low, preferably non-ozone depleting; a GWP less than about 22,200; chemical stability, as measured by a negative standard enthalpy of formation (dHf<0); a toxicity level such that when the dielectric gas leaks, the effective diluted concentration does not exceed its PEL (i.e., an Occupational Exposure Limit (OEL or TLV) of at least about 0.3 ppm); and a dielectric strength greater than air.

The dielectric gaseous compound is at least one compound selected from the group consisting of:

Arsenic pentafluoride
Arsine
Diboron tetrafluoride
Diborane
Perchloric acid, 2-chloro-1,1,2,2-tetrafluoroethyl ester (9CI)
Perchloric acid, 1,2,2-trichloro-1,2-difluoroethyl ester
Trifluoroacetyl chloride
trifluoromethylisocyanide (CF3-NC)
trifluoromethyl isocyanide
trifluoro-nitroso-ethene//Trifluor-nitroso-aethen
Tetrafluoroethene
3,3,4,4-tetrafluoro-3,4-dihydro-[1,2]diazete
(Difluoramino)difluoracetonitril
Tetrafluorooxirane
Trifluoroacetyl fluoride
Perfluormethylfluorformiat
trifluoro-acetyl hypofluorite
perfluoro-2-aza-1-propene
Perfluor-2-aza-1-propen (germ.)
N-Fluor-tetrafluor-1-aethanimin (germ.)
3,3-difluoro-2-trifluoromethyl-oxaziridine
bis-trifluoromethyl-diazene//hexafluoro-#cis!-azomethane
Fluoroxypentafluoroethane
bis-trifluoromethyl peroxide
1,1-Bis(fluoroxy)tetrafluoroaethan
Hexafluorodimethyl sulfide
3-fluoro-3#H!-diazirine-3-carbonitrile
Ethyne
1,2,2-trifluoro-aziridine
Ketene
(difluoro)vinylboran
(Difluor)vinylboran (germ.)
trifluoro-vinyl-silane
Ethinylsilan
ethyl-difluor-borane
Ethyl-difluor-boran (germ.)
methyl-methylen-amine
Dimethyl ether
vinyl-silane
Dimethylsilane
Chloroethyne
fluoroethyne//fluoro-acetylene
Ethanedinitrile
tetrafluoropropyne//1,3,3,3-tetrafluoropropyne
hexafluoro-oxetane
Trifluoro(trifluoromethyl)oxirane
1,1,1,3,3,3-Hexafluoropropanone
pentafluoro-propionyl fluoride//perfluoropropionyl fluoride
Trifluoromethyl trifluorovinyl ether
1-Propyne
Cyclopropane
Propane
Trimethylborane
cyanoketene
butatriene
Cyano-bispentafluorethyl-phosphin
Trimethyl-1,1,2,2-tetrafluorethylsilan
methyl diborane
Methyldiboran (germ.)
carbonyl bromide fluoride
chloro-difluoro-nitroso-methane//Chlor-difluor-nitroso-methan
chloroperoxytrifluoromethane
carbonylchlorid-fluorid
Carbonychloridfluorid (germ.)
3,3-difluoro-3#H!-diazirine
difluoro diazomethane
Difluordiazomethan (germ.)
Carbonyl fluoride
Difluordioxiran
difluoro-(3-fluoro-3#H!-diazirin-3-yl)-amine
trifluoromethylazide
Trifluormethylazid (germ.)
tetrafluoro-diaziridine
Fluorperoxytrifluormethan
Bis(fluoroxy)difluormethan
Trifluormethyl-phosphonylfluorid
Cyanogen fluoride
Trifluormethylphosphane (germ.)
Diazomethane
formaldehyde//Formalin
(methyl)difluoroborane
(Methyl)difluorboran (germ.)
Chloromethane
methylphosphonous acid difluoride//difluoro-methyl-phosphine
trifluoro-methoxy-silane
Methylhypofluorid
Methane
Methylsilane
#Si!-bromo-#Si!,#Si!'-methanediyl-bis-silane
#Si!-iodo-#Si!,#Si!'-methanediyl-bis-silane Difluormethylnitrit
trifluoromethanol
Formyl fluoride
Cyanic acid
Chlorine
Chlorine fluoride
Chlorine trioxide fluoride
carbon oxide selenide//Kohlenoxidselenid
Fluorine
Difluorosilane
Fluorine oxide
fluorine peroxide
Sulfuryl fluoride
sulphur difluoride
Phosphorus trifluoride oxide
Phosphorus trifluoride sulfide
tetrafluorophosphorane
Tetrafluorohydrazine
Sulfur tetrafluoride
hexafluoro disiloxane
Hexafluordisiloxan (germ.)
Nitryl fluoride
Hydrogen
Hydrogen selenide
Phosphorus trihydride
Germanium hydride
Silane
Tin tetrahydride
Oxygen
Ozone
Antimony monophosphide
Disilicon monophosphide
Radon
Argon
Trifluoroborane
Hydrogen bromide
Bromopentafluoroethane
Chlorotrifluoroethene
Trifluoroacetonitrile
trifluoromethyl isocyanate
trifluoromethyl thiocarbonyl fluoride
Trifluormethylthiocarbonylfluorid (germ.)
pentafluoro-nitroso-ethane//Pentafluor-nitroso-aethan
(trifluoromethyl-carbonyl)-difluoro-amine
Hexafluoroethane
Bis-trifluormethyl-nitroxid
bis-trifluoromethyl ether
bis(trifluoromethyl)tellurium
bis(trifluoromethyl)ditelluride
N,N-Difluor-pentafluoraethylarnin (germ.)
N-Fluor-bis(trifluormethyl)-amin (germ.)
N-Fluor-N-trifluormethoxy-perfluormethylamin (germ.)
fluoroformyl cyanide
1-chloro-1-fluoro-ethene//1-Chlor-1-fluor-aethen//1-chloro-1-fluoroethylene
1,1-Difluoroethene
#trans!-1,2-difluoro-ethene//#trans!-vinylene difluoride//(E)-1,2-difluoroethylene//(E)-1,2-difluoro-ethene//#trans!-vinylene fluoride
1,2-difluoro-ethene//#cis!-vinylene difluoride//1,2-Difluor-aethen//vinylene fluoride
#cis!-1,2-difluoro-ethene//#cis!-vinylene difluoride//(Z)-1,2-difluoroethylene//(Z)-1,2-difluoro-ethene//#cis!-vinylene fluoride
1,1,1,2-Tetrafluoroethane
1,1,2,2-Tetrafluoroethane
Fluoroethene
1,1,1-Trifluoroethane
Ether, methyl trifluoromethyl
Ethene
1,1-Difluoroethane
Fluoroethane
Ethane
fluoro-dimethyl-borane
Disiloxane, 1,1,3,3-tetrafluoro-1,3-dimethyl-Trifluoroethene
trifluoroacetaldehyde//Trifluor-acetaldehyd
Pentafluoroethane
Difluoromethyl trifluoromethyl ether
Tris(trifluoromethyl)bismuth
tetrafluoropropadiene//tetrafluoro-allene//1,1,3,3-tetrafluoro-1,2-propadiene
tetrafluorocyclopropene
Perfluoropropionyliodid
pentafluoro-propionitrile//pentafluoropropiononitrile
hexafluoro-cyclopropane//Hexafluor-cyclopropan//freon-#C!216
Hexafluoropropylene
hexafluoro-[1,3]dioxolane
Octafluoropropane
Perfluormethylethylether
1,1-difluoro-propadiene//allenylidene difluoride/1,1-difluoro-allene
2,3,3,3-tetrafluoro-propene//HFO-1234yf
trans HFO-1234ze
3,3,3-Trifluoropropene
cyclopropene
Allene
1,1-difluoro-propene//propenylidene difluoride//1,1-Difluor-propen
methylketene
2-fluoropropene
1-Propene
DL-2-aminopropanoic acid
3,3,3-trifluoro-propyne//3,3,3-Trifluor-propin//trifluoromethyl-ethyne//3,3,3-trifluoro-1-propyne
1,1,3,3,3-pentafluoro-propene//1,1,3,3,3-Pentafluor-propen
1,2,3,3,3-pentafluoro-propene
1,1,1,4,4,4-hexafluoro-2-butyne
1,1,4,4-tetrafluoro-butane-2,3-dione
Trifluormethylhypochlorit
Chlor-difluor-methyl-hypofluorit
N-Chlor-N-fluor-trifluormethylamin (germ.)
Chlordifluordifluoraminomethan
thiocarbonyl difluoride
Thiocarbonyldifluorid (germ.)
selenocarbonyl difluoride
Trifluoroiodomethane
N-Fluor-difluormethanimin (germ.)
trifluoro-nitroso-methane//Trifluor-nitroso-methan
difluoro-carbamoyl fluoride
trifluoro-nitro-methane//Trifluor-nitro-methan//fluoropicrin
Tetrafluoromethane
Tetrafluorformamidin (germ.)
tetrafluorourea
hypofluorous acid trifluoromethyl ester//Hypofluorigsaeure-trifluormethylester//trifluoromethyl hypofluorite
trifluoromethanesulfonyl fluoride
N,N-Difluor-trifluormethylamin (germ.)
Trifluormethyloxydifluoramin
(Difluoraminoxy)difluormethylhypofluorit
sulfurcyanide pentafluoride
Schwefelcyanid-pentafluorid (germ.)
difluoro-trifluoromethyl-phosphine Hexafluormethandiamin
perfluoro methyl silane
Perfluormethylsilan (germ.)
Trifluormethyl-tetrafluorphosphoran (germ.)
Difluoromethane
Fluoroiodomethane
fluoromethane//methyl fluoride//Fluor-methan//freon-41
trifluoromethyl-silane" CF3SiH3
methyltrifluorosilane
difluoro-methyl-silane
fluoro-methyl-silane
methylgermane
Difluorformimin
Trifluoromethane
trifluoromethane thiol
Trifluormethanthiol (germ.)
N,N,1,1-Tetrafluormethylamin
difluoro dichlorosilane
Difluordichlorsilan (germ.)
difluoro chlorosilane
Difluorchlorsilan (germ.)
Phosphorus chloride difluoride
Chlorotrifluorosilane
Hydrogen chloride
Chlorosilane
Carbon monoxide
Carbon dioxide
Carbonyl sulfide
Difluoramine
trans-Difluorodiazine
cis-Difluorodiazine
Thionyl fluoride
Trifluorosilane
Nitrogen trifluoride
Trifluoramine oxide
thiazyl trifluoride
Phosphorus trifluoride
Germanium(IV) fluoride
Tetrafuorosilane
Phosphorus pentafluoride
Selenium hexafluoride
Tellurium hexafluoride
fluorosilane
Nitrosyl fluoride
Fluorine nitrate
Hydrogen sulfide
Ammonia
Helium
Hydrogen iodide
Krypton
Nitrogen
dinitrogen oxide
Neon
Nitrogen oxide; and
Xenon More preferably, the dielectric compounds can be selected from the group consisting of:

Argon
Trifluoroborane
Hydrogen bromide
Bromopentafluoroethane
Chlorotrifluoroethene
Trifluoroacetonitrile
trifluoromethyl isocyanate
trifluoromethyl thiocarbonyl fluoride
Trifluormethylthiocarbonylfluorid (germ.)
pentafluoro-nitroso-ethane//Pentafluor-nitroso-aethan
(trifluoromethyl-carbonyl)-difluoro-amine
Hexafluoroethane
Bis-trifluormethyl-nitroxid
bis-trifluoromethyl ether
bis(trifluoromethyl)tellurium
bis(trifluoromethyl)ditelluride
N,N-Difluor-pentafluoraethylamin (germ.)
N-Fluor-bis(trifluormethyl)-amin (germ.)
N-Fluor-N-trifluormethoxy-perfluormethylamin (germ.)
fluoroformyl cyanide
1-chloro-1-fluoro-ethene//1-Chlor-1-fluor-aethen//1-chloro-1-fluoroethylene 1,1-Difluoroethene
#trans!-1,2-difluoro-ethene//#trans!-vinylene difluoride//(E)-1,2-difluoroethylene//(E)-1,2-difluoro-ethene//#trans!-vinylene fluoride
1,2-difluoro-ethene//#cis!-vinylene difluoride//1,2-Difluor-aethen//vinylene fluoride
#cis!-1,2-difluoro-ethene//#cis!-vinylene difluoride//(Z)-1,2-difluoroethylene//(Z)-1,2-difluoro-ethene//#cis!-vinylene fluoride
1,1,1,2-Tetrafluoroethane
1,1,2,2-Tetrafluoroethane
Fluoroethene
1,1,1-Trifluoroethane
Ether, methyl trifluoromethyl
Ethene
1,1-Difluoroethane
Fluoroethane
Ethane
fluoro-dimethyl-borane
Disiloxane, 1,1,3,3-tetrafluoro-1,3-dimethyl-Trifluoroethene
trifluoroacetaldehyde//Trifluor-acetaldehyd
Pentafluoroethane
Difluoromethyl trifluoromethyl ether
Tris(trifluoromethyl)bismuth
tetrafluoropropadiene//tetrafluoro-allene//1,1,3,3-tetrafluoro-1,2-propadiene
tetrafluorocyclopropene
Perfluoropropionyliodid
pentafluoro-propionitrile//pentafluoropropiononitrile
hexafluoro-cyclopropane//Hexafluor-cyclopropan//freon-#C!216
Hexafluoropropylene
hexafluoro-[1,3]dioxolane
Octafluoropropane
Perfluormethylethylether
1,1-difluoro-propadiene//allenylidene difluoride//1,1-difluoro-allene
2,3,3,3-tetrafluoro-propene//HFO-1234yf
trans HFO-1234ze
3,3,3-Trifluoropropene
cyclopropene
Allene
1,1-difluoro-propene//propenylidene difluoride//1,1-Difluor-propen
methylketene
2-fluoropropene
1-Propene
DL-2-aminopropanoic acid
3,3,3-trifluoro-propyne//3,3,3-Trifluor-propin//trifluoromethyl-ethyne//3,3,3-trifluoro-1-propyne
1,1,3,3,3-pentafluoro-propene//1,1,3,3,3-Pentafluor-propen
1,2,3,3,3-pentafluoro-propene
1,1,1,4,4,4-hexafluoro-2-butyne
1,1,4,4-tetrafluoro-butane-2,3-dione
Trifluormethylhypochlorit
Chlor-difluor-methyl-hypofluorit N-Chlor-N-fluor-trifluormethylamin (germ.)
Chlordifluordifluoraminomethan
thiocarbonyl difluoride
Thiocarbonyldifluorid (germ.)
selenocarbonyl difluoride
Trifluoroiodomethane
N-Fluor-difluormethanimin (germ.)
trifluoro-nitroso-methane//Trifluor-nitroso-methan
difluoro-carbamoyl fluoride
trifluoro-nitro-methane//Trifluor-nitro-methan//fluoropicrin
Tetrafluoromethane
Tetrafluorformamidin (germ.)
tetrafluorourea
hypofluorous acid trifluoromethyl ester//Hypofluorigsaeure-trifluormethylester//trifluoromethyl hypofluorite
trifluoromethanesulfonyl fluoride
N,N-Difluor-trifluormethylamin (germ.)
Trifluormethyloxydifluoramin
(Difluoraminoxy)difluormethylhypofluorit
sulfurcyanide pentafluoride
Schwefelcyanid-pentafluorid (germ.)
difluoro-trifluoromethyl-phosphine
Hexafluormethandiamin
perfluoro methyl silane
Perfluormethylsilan (germ.)
Trifluormethyl-tetrafluorphosphoran (germ.)
Difluoromethane
Fluoroiodomethane
fluoromethane//methyl fluoride//Fluor-methan//freon-41
trifluoromethyl-silane" CF3SiH3
methyltrifluorosilane
difluoro-methyl-silane
fluoro-methyl-silane
methylgermane
Difluorformimin
Trifluoromethane
trifluoromethane thiol
Trifluormethanthiol (germ.)
N,N,1,1-Tetrafluormethylamin
difluoro dichlorosilane
Difluordichlorsilan (germ.)
difluoro chlorosilane
Difluorchlorsilan (germ.)
Phosphorus chloride difluoride
Chlorotrifluorosilane
Hydrogen chloride
Chlorosilane
Carbon monoxide
Carbon dioxide
Carbonyl sulfide
Difluoramine
trans-Difluorodiazine
cis-Difluorodiazine
Thionyl fluoride
Trifluorosilane
Nitrogen trifluoride
Trifluoramine oxide
thiazyl trifluoride
Phosphorus trifluoride
Germanium(IV) fluoride
Tetrafuorosilane
Phosphorus pentafluoride
Selenium hexafluoride
Tellurium hexafluoride
fluorosilane
Nitrosyl fluoride
Fluorine nitrate
Hydrogen sulfide
Ammonia
Helium
Hydrogen iodide
Krypton
Nitrogen
Nitrous oxide
Neon
Nitrogen oxide; and
Xenon The dielectric gaseous compound is optionally formed as an azeotrope, which imparts many advantages in handling the mixture. Preferred mixtures for dielectric gaseous compound contain one additional gas selected from the group consisting of: nitrogen, $CO_2$ and $N_2O$.

The present disclosure also includes an insulation-gas for use in electrical equipment, wherein said insulation-gas is a dielectric gaseous compound which exhibits the following properties: a boiling point in the range between about −20° C. to about −273° C.; low, preferably non-ozone depleting; a GWP less than about 22,200; chemical stability, as measured by a negative standard enthalpy of formation (dHf<0); a toxicity level such that when the dielectric gas leaks, the effective diluted concentration does not exceed its PEL (i.e., Occupational Exposure Limit (OEL or TLV) of at least about 0.3 ppm); and a dielectric strength greater than air.

Preferably, the electrical equipment is at least one selected from the group consisting of: gas-insulated circuit breakers and current-interruption equipment, gas-insulated transmission lines, gas-insulated transformers, and gas-insulated substations.

DETAILED DESCRIPTION OF THE PREFERRED EMBODIMENT

The compounds of the present disclosure are useful in gaseous phase for electrical insulation and for arc quenching and current interruption equipment used in the transmission and distribution of electrical energy. Generally, there are four major types of electrical equipment which the gases of the present disclosure can be used for insulation and/or interruption purposes: (1) gas-insulated circuit breakers and current-interruption equipment, (2) gas-insulated transmission lines, (3) gas-insulated transformers, and (4) gas-insulated substations. Such gas-insulated equipment is a major component of power transmission and distribution systems all over the world. It offers significant savings in land use, is aesthetically acceptable, has relatively low radio and audible noise emissions, and enables substations to be installed in populated areas close to the loads.

Depending on the particular function of the gas-insulated equipment, the gas properties which are the most significant vary.

For circuit breakers the excellent thermal conductivity and high dielectric strength of such gases, along with the fast thermal and dielectric recovery (short time constant for increase in resistivity), are the main reasons for its high interruption capability. These properties enable the gas to make a rapid transition between the conducting (arc plasma) and the dielectric state of the arc, and to withstand the rise of the recovery voltage.

For gas-insulated transformers the cooling ability, compatibility with solid materials, and partial discharge characteristics, added to the dielectric characteristics, make them a desirable medium for use in this type of electrical equipment. The compounds have distinct advantages over oil insulation, including none of the fire safety problems or environmental problems related to oil, high reliability, flexible layout, little maintenance, long service life, lower noise, better handling, and lighter equipment.

For gas-insulated transmission lines the dielectric strength of the gaseous medium under industrial conditions is of paramount importance, especially the behavior of the gaseous dielectric under metallic particle contamination, switching and lightning impulses, and fast transient electrical stresses. These gases also have a high efficiency for transfer of heat from the conductor to the enclosure and are stable for long periods of time (e.g., 40 years). These gas-insulated transmission lines offer distinct advantages: cost effectiveness, high-carrying capacity, low losses, availability at all voltage ratings, no fire risk, reliability, and a compact alternative to overhead high voltage transmission lines in congested areas that avoids public concerns with overhead transmission lines.

For gas-insulated substations, the entire substation (circuit breakers, disconnects, grounding switches, busbar, transformers, etc., are interconnected) is insulated with the gaseous dielectric medium of the present disclosure, and, thus, all of the above-mentioned properties of the dielectric gas are significant.

The properties of a dielectric gas that are necessary for its use in high voltage equipment are many and vary depending on the particular application of the gas and the equipment.

Intrinsic properties are those properties of a gas which are inherent in the physical atomic or molecular structure of the gas. These properties are independent of the application or the environment in which a gas is placed. One of the desirable properties of a gaseous dielectric is high dielectric strength (higher, for instance than air). The gas properties that are principally responsible for high dielectric strength are those that reduce the number of electrons which are present in an electrically-stressed dielectric gas. To effect such a reduction in the electron number densities, as gas should: (i) be electronegative (remove electrons by attachment over as wide an energy range as possible); it should preferably exhibit increased electron attachment with increasing electron energy and gas temperature since electrons have a broad range of energies and the gas temperature in many applications is higher than ambient; (ii) have good electron slowing-down properties (slow electrons down so that they can be captured efficiently at lower energies and be prevented from generating more electrons by electron impact ionization); and (iii) have low ionization cross section and high ionization onset (prevent ionization by electron impact). Besides the above properties, there are a number of other basic properties which are necessary for the complete characterization of the dielectric gas behavior and its performance in practice, e.g., secondary processes such as electron emission from surfaces by ion and photon impact; photoprocesses; absorption of photoionizing radiation (this is a controlling factor in discharge development in non-uniform fields); dissociation under electron impact decomposition; ion-molecule reactions; reactions with trace impurities; and reactions with surfaces.

The dielectric gas must also have the following chemical properties: high vapor pressure; high specific heat, high thermal conductivity for gas cooling; thermal stability over long periods of time for temperatures greater than 400° K.; chemical stability and inertness with regard to conducting and insulating materials; non-flammable; toxicity acceptable for industrial exposure; and non-explosive. When used in mixtures, it must have appropriate thermodynamic properties for mixture uniformity, composition, and separation.

Extrinsic properties are those which describe how a gas may interact with its surroundings, or in response to external influences, such as electrical breakdown and discharges. To be used in electrical applications, a dielectric gas should: (undergo no extensive decomposition; lead to no polymerization; form no carbon or other deposits; and be non-corrosive and non-reactive to metals, insulators, spacers, and seals. In addition it should have: no byproduct with toxicity unacceptable for industrial applications; removable byproducts; and a high recombination rate for reforming itself, especially for arc interruption. Finally, the gas must be environmentally friendly, e.g., it must not contribute to global warming, must not deplete stratospheric ozone, and must not persist in the environment for long periods of time.

Specific properties of the gas under discharge and breakdown conditions include: a high breakdown voltage under uniform and non-uniform electric fields; insensitivity to surface roughness or defects and freely moving conducting particles; good insulation properties under practical conditions; good insulator flashover characteristics; good heat transfer characteristics; good recovery (rate of voltage recovery) and self-healing; no adverse reactions with moisture and common impurities; and no adverse effects on equipment, especially on spacers and electrode surfaces.

Specific properties of gaseous insulators for specific electrical equipment is set forth below:

Circuit breakers—The most significant required gas properties for arc interruption are: (i) high dielectric strength comparable to that of $SF_6$; (ii) high thermal conductivity; (iii) fast gas recovery; and (iv) self-healing/dielectric integrity.

Gas-insulated transmission lines—The required properties include: (i) high dielectric strength; (ii) high vapor pressure at operating and ambient temperature; (iii) chemical inertness; (iv) high thermal conductivity; (v) no thermal aging; (vi) no deposits; (vii) easily removable, non-harmful byproducts; and (viii) no unacceptable level of hazards (fire, explosion, toxicity, corrosion).

Gas-insulated transformers—The properties of the gas required for this application include: (i) high dielectric strength at reasonable pressures (e.g., 500 kPa); (ii) low boiling point; (iii) acceptably low toxicity; (iv) chemical inertness; (v) good thermal stability; (vi) non-flammable; (vii) high cooling capability; (viii) good compatibility with solid materials; (ix) good partial discharge characteristics; (x) useable over a range of temperatures; and (xi) safe, easy to handle, inexpensive and securely available.

The present inventors have discovered a unique series of dielectric gases for use in electric equipment applications, which exhibit many of the aforementioned properties, which avoiding the greenhouse problems associated with $SF_6$. Such dielectric compounds exhibit at least one of the following properties:

A boiling point in the range between about −20° C. to about −273° C.

Low, preferably, Non-ozone depleting

A GWP less than about 22,200

Chemical stability, as measured by a negative standard enthalpy of formation (dHf<0)

A toxicity level such that when the working gas leaks from equipment at the manufacturer's specified maximum leak rate, the effective diluted concentration does not exceeed its PEL, i.e., does not exceed the PEL of that specific compound. In general with minimal ventilation PELs greater than about 0.3 ppm by volume are acceptable (i.e., an Occupational Exposure Limit (OEL or TLV) of at least about 0.3 ppm). OSHA sets enforceable permissible exposure limits (PELs) to protect workers against the health effects of exposure to hazardous substances. OSHA PELs are based on an 8-hour time weighted average (TWA) exposure. Approximately 500 PELs have been established. Existing PELs are contained in 29 CFR 1910.1000, the air contaminants standard. Most PELs are listed in 29 CFR 1910.1000, Table Z-1, and 29 CFR 1910.1000, Table Z-2.

A dielectric strength greater than air.

These unique dielectric gases are at least one gas selected from the group consisting of those set forth in Table 1 below:

TABLE 1

| Dielectric Compound | Structure | Name | CAS | MW | MY BP(° C.) |
|---|---|---|---|---|---|
| AsF5 | AsF5 | Arsenic pentafluoride | 7784-36-3 | 169.91 | −52.8 |
| AsH3 | AsH3 | Arsine | 7784-42-1 | 77.95 | −62.2 |
| B2F4 | B2F4 | Diboron tetrafluoride | 13965-73-6 | 97.61 | −34.2 |
| B2H6 | H2B(H2)BH2 | Diborane | 19287-45-7 | 27.67 | −92.3 |
| C2Cl2F4O4 | O3ClOCF2CF2Cl | Perchloric acid, 2-chloro-1,1,2,2-tetrafluoroethyl ester (9CI) | 38126-28-2 | 234.92 | −95.0 |
| C2Cl4F2O4 | O3ClOCFClCFCl2 | Perchloric acid, 1,2,2-trichloro-1,2-difluoroethyl ester | 38126-29-3 | 267.83 | −35.0 |
| C2ClF3O | CF3CCl(O) | Trifluoroacetyl chloride | 354-32-5 | 132.47 | −27.0 |
| C2F3N | (CF3)—NC | trifluoromethylisocyanide (CF3—NC) | 19480-01-4 | 95.02 | −84.0 |
| C2F3N | CF3—NC | trifluoromethyl isocyanide | 19480-01-4 | 95.02 | −35.0 |
| C2F3NO | CF2═CF—NO | trifluoro-nitroso-ethene//Trifluor-nitroso-aethen | 2713-04-4 | 111.02 | −23.7 |
| C2F4 | C2F4 | Tetrafluoroethene | 116-14-3 | 100.02 | −75.6 |
| C2F4N2 | cyclo —CF2—N═N—CF2—' | 3,3,4,4-tetrafluoro-3,4-dihydro-[1,2]diazete | 694-60-0 | 128.03 | −36.0 |
| C2F4N2 | NF2—CF2—CN | (Difluoramino)difluoracetonitril | 5131-88-4 | 128.03 | −32.0 |
| C2F4O | O(CF2CF2) | Tetrafluorooxirane | 694-17-7 | 116.01 | −63.5 |
| C2F4O | CF3CF(O) | Trifluoroacetyl fluoride | 354-34-7 | 116.01 | −59.0 |
| C2F4O2 | FC(O)OCF3 | Perfluormethylfluorformiat | 3299-24-9 | 132.01 | −33.0 |
| C2F4O2 | CF3C(O)OF | trifluoro-acetyl hypofluorite | 359-46-6 | 132.01 | −25.0 |
| C2F5N | CF3N═CF2 | perfluoro-2-aza-1-propene Perfluor-2-aza-1-propen (germ.) | | 133.02 | −34.0 |
| C2F5N | CF3CFNF | N-Fluor-tetrafluor-1-aethanimin (germ.) | 758-35-0 | 133.02 | −32.0 |
| C2F5NO | cyclo(—CF2—N(CF3)—O—) | 3,3-difluoro-2-trifluoromethyl-oxaziridine | 60247-20-3 | 149.02 | −34.8 |
| C2F6N2 | (CF3)N═N(CF3) | bis-trifluoromethyl-diazene//hexafluoro-#cis!-azomethane | 372-63-4 | 166.03 | −20.0 |
| C2F6O | C2F5OF | Fluoroxypentafluoroethane | 3848-94-0 | 154.01 | −50.0 |
| C2F6O2 | CF3—O—O—CF3 | bis-trifluoromethyl peroxide | 927-84-4 | 170.01 | −40.0 |
| C2F6O2 | CF3C(OF)2F | 1,1-Bis(fluoroxy)tetrafluoroaethan | 16329-92-3 | 170.01 | −35.0 |
| C2F6S | (CF3)2S | Hexafluorodimethyl sulfide | 371-78-8 | 170.08 | −22.2 |
| C2FN3 | (—N═N—) CF(CN) | 3-fluoro-3#H!-diazirine-3-carbonitrile | 4849-85-8 | 85.04 | −30.0 |
| C2H2 | HCCH | Ethyne | 74-86-2 | 26.04 | −84.7 |
| C2H2F3N | —CF2—NF—CH2— | 1,2,2-trifluoro-aziridine | 1514-44-9 | 97.04 | −24.0 |
| C2H2O | CH2CO | Ketene | 463-51-4 | 42.04 | −49.8 |
| C2H3BF2 | F2BCHCH2 | (difluoro)vinylboran (Difluor)vinylboran (germ.) | 358-95-2 | 75.85 | −38.8 |
| C2H3F3Si | F3Si—CH═CH2 | trifluoro-vinyl-silane | 421-24-9 | 112.13 | −25.0 |
| C2H4Si | HCCSiH3 | Ethinylsilan | 1066-27-9 | 56.14 | −22.4 |
| C2H5BF2 | (C2H5)F2B | ethyl-difluor-borane Ethyl-difluor-boran (germ.) | 430-41-1 | 77.87 | −25.0 |
| C2H5N | CH2═NCH3 | methyl-methylen-amine | 1761-67-7 | 43.07 | −35.0 |
| C2H6O | CH3OCH3 | Dimethyl ether | 115-10-6 | 46.07 | −24.8 |
| C2H6Si | H2CCHSiH3 | vinyl-silane | 7291-09-0 | 58.15 | −22.8 |
| C2H8Si | (CH3)2SiH2 | Dimethylsilane | 1111-74-6 | 60.17 | −20.2 |
| C2HCl | ClCCH | Chloroethyne | 593-63-5 | 60.48 | −30.2 |
| C2HF | | fluoroethyne//fluoro-acetylene | 2713-09-9 | 44.03 | −105.0 |
| C2N2 | NCCN | Ethanedinitrile | 460-19-5 | 52.03 | −21.2 |
| C3F4 | FCCCF3 | tetrafluoropropyne//1,3,3,3-tetrafluoropropyne | 20174-11-2 | 112.03 | −50.0 |
| C3F6O | cyclo-CF2—CF2—O—CF2— | hexafluoro-oxetane | 425-82-1 | 166.02 | −38.0 |
| C3F6O | cyclo(—CF2—O—CF(CF3)—) | Trifluoro(trifluoromethyl)oxirane | 428-59-1 | 166.02 | −27.4 |
| C3F6O | (CF3)2CO | 1,1,1,3,3,3-Hexafluoropropanone | 684-16-2 | 166.02 | −27.3 |

TABLE 1-continued

| Dielectric Compound | Structure | Name | CAS | MW | MY BP(° C.) |
|---|---|---|---|---|---|
| C3F6O | CF3CF2C(O)F | pentafluoro-propionyl fluoride//perfluoropropionyl fluoride | 422-61-7 | 166.02 | −27.0 |
| C3F6O | CF3OCFCF2 | Trifluoromethyl trifluorovinyl ether | 1187-93-5 | 166.02 | −26.0 |
| C3H4 | CH3CCH | 1-Propyne | 74-99-7 | 40.06 | −23.2 |
| C3H6 | —CH2CH2CH2— | Cyclopropane | 75-19-4 | 42.08 | −32.8 |
| C3H8 | CH3CH2CH3 | Propane | 74-98-6 | 44.10 | −42.0 |
| C3H9B | B(CH3)3 | Trimethylborane | 593-90-8 | 55.92 | −20.2 |
| C3HNO | OCCHCN | cyanoketene | 4452-08-8 | 67.05 | −34.0 |
| C4H4 | CH2═C═C═CH2 | butatriene | 2873-50-9 | 52.08 | −78.0 |
| C5F10NP | (C2F5)2PCN | Cyano-bispentafluorethyl-phosphin | 35449-90-2 | 295.02 | −78.0 |
| C5H10F4Si | CHF2CF2Si(CH3)3 | Trimethyl-1,1,2,2-tetrafluorethylsilan | 4168-08-5 | 174.21 | −72.0 |
| CB2H8 | CH3B2H5 | methyl diborane Methyldiboran (germ.) | 23777-55-1 | 41.70 | −35.0 |
| CBrFO | COBrF | carbonyl bromide fluoride | 753-56-0 | 126.91 | −20.6 |
| CClF2NO | (F2Cl)CN═O | chloro-difluoro-nitroso-methane//Chlor-difluor-nitroso-methan | 421-13-6 | 115.47 | −35.0 |
| CClF3O2 | CF3—O—O—Cl | chloroperoxytrifluoromethane | 32755-26-3 | 136.46 | −22.0 |
| CClFO | COClF | carbonylchlorid-fluorid Carbonychloridfluorid (germ.) | 353-49-1 | 82.46 | −46.0 |
| CF2N2 | F2C(—N═N—) | 3,3-difluoro-3#H!-diazirine | 693-85-6 | 78.02 | −91.3 |
| CF2N2 | F2C═N═N | difluoro diazomethane Difluordiazomethan (germ.) | 814-73-3 | 78.02 | −91.3 |
| CF2O | F2CO | Carbonyl fluoride | 353-50-4 | 66.01 | −84.6 |
| CF2O2 | F2C(OO) | Difluordioxiran | 96740-99-7 | 82.01 | −85.0 |
| CF3N3 | (NF2)(F)C(—N═N—) | difluoro-(3-fluoro-3#H!-diazirin-3-yl)-amine | 4823-43-2 | 111.03 | −36.0 |
| CF3N3 | CF3—N—N—N | trifluoromethylazide Trifluormethylazid (germ.) | 3802-95-7 | 110.03 | −28.5 |
| CF4N2 | cyclo-(—NF—NF—CF2—) | tetrafluoro-diaziridine | 17224-09-8 | 116.02 | −35.0 |
| CF4O2 | CF3—O—O—F | Fluorperoxytrifluormethan | 34511-13-2 | 120.00 | −69.4 |
| CF4O2 | F2C(OF)2 | Bis(fluoroxy)difluormethan | 16282-67-0 | 120.00 | −64.0 |
| CF5OP | OPF2CF3 | Trifluormethyl-phosphonylfluorid | 19162-94-8 | 153.98 | −20.1 |
| CFN | | Cyanogen fluoride | 1495-50-7 | 45.02 | −46.2 |
| CH2F3P | CF3PH2 | Trifluormethylphosphane (germ.) | 420-52-0 | 102.00 | −26.5 |
| CH2N2 | H2CNN | Diazomethane | 334-88-3 | 42.04 | −23.2 |
| CH2O | | formaldehyde//Formalin | 50-00-0 | 30.03 | −21.0 |
| CH3BF2 | CH3BF2 | (methyl)difluoroborane (Methyl)difluorboran (germ.) | 373-64-8 | 63.84 | −62.3 |
| CH3Cl | CH3Cl | Chloromethane | 74-87-3 | 50.49 | −24.2 |
| CH3F2P | F2PCH3 | methylphosphonous acid difluoride//difluoro-methyl-phosphine | | 84.01 | −28.0 |
| CH3F3OSi | F3Si—O—CH3 | trifluoro-methoxy-silane | 25711-11-9 | 116.11 | −78.0 |
| CH3FO | CH3—O—F | Methylhypofluorid | 36336-08-0 | 50.03 | −33.0 |
| CH4 | CH4 | Methane | 74-82-8 | 16.04 | −161.5 |
| CH6Si | CH3SiH3 | Methylsilane | 992-94-9 | 46.14 | −56.9 |
| CH7BrSi2 | H3Si—CH2—SiH2Br | #Si!-bromo-#Si!,#Si!'-methanediyl-bis-silane | 56962-86-8 | 155.14 | −64.0 |
| CH7ISi2 | H3Si—CH2—SiH2I | #Si!-iodo-#Si!,#Si!'-methanediyl-bis-silane | 56962-87-9 | 202.14 | −49.0 |
| CHF2NO2 | F2CH—O—NO | Difluormethylnitrit | 1493-06-7 | 97.02 | −20.0 |
| CHF3O | F3COH | trifluoromethanol | 1493-11-4 | 86.01 | −20.0 |
| CHFO | HFCO | Formyl fluoride | 1493-02-3 | 48.02 | −26.5 |
| CHNO | HOCN | Cyanic acid | 420-05-3 | 43.03 | −64.2 |
| Cl2 | Cl2 | Chlorine | 7782-50-5 | 70.91 | −34.0 |
| ClF | ClF | Chlorine fluoride | 7790-89-8 | 54.45 | −101.0 |
| ClFO3 | | Chlorine trioxide fluoride | 7616-94-6 | 102.45 | −46.7 |
| COSe | Se═C═O | carbon oxide selenide//Kohlenoxidselenid | 1603-84-5 | 106.97 | −21.7 |
| F2 | F2 | Fluorine | 7782-41-4 | 38.00 | −188.2 |
| F2H2Si | SiF2H2 | Difluorosilane | 13824-36-7 | 68.10 | −77.8 |
| F2O | OF2 | Fluorine oxide | 7783-41-7 | 54.00 | −144.7 |
| F2O2 | FOOF | fluorine peroxide | 7783-44-0 | 70.00 | −57.0 |
| F2O2S | SO2F2 | Sulfuryl fluoride | 2699-79-8 | 102.06 | −55.3 |
| F2S | SF2 | sulphur difluoride | 13814-25-0 | 70.06 | −35.0 |
| F3OP | POF3 | Phosphorus trifluoride oxide | 13478-20-1 | 103.97 | −39.7 |

TABLE 1-continued

| Dielectric Compound | Structure | Name | CAS | MW | MY BP(° C.) |
|---|---|---|---|---|---|
| F3PS | PSF3 | Phosphorus trifluoride sulfide | 2404-52-6 | 120.03 | −52.3 |
| F4HP | PHF4 | tetrafluorophosphorane | 13659-66-0 | 107.98 | −37.0 |
| F4N2 | F2NNF2 | Tetrafluorohydrazine | 10036-47-2 | 104.01 | −74.2 |
| F4S | SF4 | Sulfur tetrafluoride | 7783-60-0 | 108.05 | −40.5 |
| F6OSi2 | SiF3OSiF3 | hexafluoro disiloxane Hexafluordisiloxan (germ.) | 14515-39-0 | 186.16 | −23.0 |
| FNO2 | O2NF | Nitryl fluoride | 10022-50-1 | 65.00 | −72.3 |
| H2 | H2 | Hydrogen | 1333-74-0 | 2.02 | −252.9 |
| H2Se | H2Se | Hydrogen selenide | 7783-07-5 | 80.98 | −41.3 |
| H3P | PH3 | Phosphorus trihydride | 7803-51-2 | 34.00 | −87.8 |
| H4Ge | GeH4 | Germanium hydride | 7782-65-2 | 76.62 | −88.2 |
| H4Si | SiH4 | Silane | 7803-62-5 | 32.12 | −112.2 |
| H4Sn | SnH4 | Tin tetrahydride | 2406-52-2 | 122.72 | −51.8 |
| O2 | O2 | Oxygen | 7782-44-7 | 32.00 | −183.0 |
| O3 | O3 | Ozone | 10028-15-6 | 48.00 | −111.3 |
| PSb | SbP | Antimony monophosphide | na | 152.72 | −52.3 |
| PSi2 | Si2P | Disilicon monophosphide | na | 87.14 | −52.3 |
| Rn | Rn | Radon | 10043-92-2 | 222.00 | −61.7 |
| Ar | Ar | Argon | 7440-37-1 | 39.95 | −185.9 |
| BF3 | BF3 | Trifluoroborane | 7637-07-2 | 67.81 | −101.2 |
| BrH | HBr | Hydrogen bromide | 10035-10-6 | 80.91 | −66.7 |
| C2BrF5 | CF3CF2Br | Bromopentafluoroethane | 354-55-2 | 198.92 | −21.0 |
| C2ClF3 | CFCl═CF2 | Chlorotrifluoroethene | 79-38-9 | 116.47 | −28.4 |
| C2F3N | CF3CN | Trifluoroacetonitrile | 353-85-5 | 95.02 | −68.8 |
| C2F3NO | (CF3)NCO | trifluoromethyl isocyanate | 460-49-1 | 111.02 | −36.0 |
| C2F4S | CF3C(S)F | trifluoromethyl thiocarbonyl fluoride Trifluormethylthiocarbonylfluorid (germ.) | | 132.08 | −21.0 |
| C2F5NO | CF3CF2NO | pentafluoro-nitroso-ethane//Pentafluor-nitroso-aethan | 354-72-3 | 149.02 | −45.7 |
| C2F5NO | CF3C(O)NF2 | (trifluoromethyl-carbonyl)-difluoro-amine | 32822-49-4 | 149.02 | −21.1 |
| C2F6 | CF3CF3 | Hexafluoroethane | 76-16-4 | 138.01 | −78.2 |
| C2F6NO | CF3N(O)CF3 | Bis-trifluormethyl-nitroxid | 2154-71-4 | 168.02 | −20.0 |
| C2F6O | CF3OCF3 | bis-trifluoromethyl ether | 1479-49-8 | 154.01 | −59.0 |
| C2F6Te | (CF3)2Te | bis(trifluoromethyl)tellurium | 55642-42-7 | 265.61 | −98.0 |
| C2F6Te2 | CF3TeTeCF3 | bis(trifluoromethyl) ditelluride | 1718-20-3 | 393.21 | −53.0 |
| C2F7N | CF3CF2NF2 | N,N-Difluor-pentafluoraethylamin (germ.) | 354-80-3 | 171.02 | −38.0 |
| C2F7N | (CF3)2NF | N-Fluor-bis(trifluormethyl)-amin (germ.) | 359-62-6 | 171.02 | −37.0 |
| C2F7NO | CF3NFOCF3 | N-Fluor-N-trifluormethoxy-perfluormethylamin (germ.) | 4217-92-9 | 187.02 | −25.0 |
| C2FNO | FC(O)CN | fluoroformyl cyanide | 683-55-6 | 73.03 | −21.0 |
| C2H2ClF | CH2CFCl | 1-chloro-1-fluoro-ethene//1-Chlor-1-fluor-aethen//1-chloro-1-fluoroethylene | 2317-91-1 | 80.49 | −25.5 |
| C2H2F2 | CF2═CH2 | 1,1-Difluoroethene | 75-38-7 | 64.03 | −85.7 |
| C2H2F2 | CHF═CHF | #trans!-1,2-difluoro-ethene//#trans!-vinylene difluoride//(E)-1,2-difluoroethylene//(E)-1,2-difluoro-ethene//#trans!-vinylene fluoride | 1630-78-0 | 64.03 | −53.1 |
| C2H2F2 | FHC═CHF | 1,2-difluoro-ethene//#cis!-vinylene difluoride//1,2-Difluor-aethen//vinylene fluoride | 1691-13-0 | 64.03 | −28.0 |
| C2H2F2 | CHF═CHF | #cis!-1,2-difluoro-ethene//#cis!-vinylene difluoride//(Z)-1,2-difluoroethylene//(Z)-1,2-difluoro-ethene//#cis!-vinylene fluoride | 1630-77-9 | 64.03 | −26.0 |
| C2H2F4 | CF3CH2F | 1,1,1,2-Tetrafluoroethane | 811-97-2 | 102.03 | −26.1 |
| C2H2F4 | CF2HCF2H | 1,1,2,2-Tetrafluoroethane | 359-35-3 | 102.03 | −23.0 |
| C2H3F | CH2═CHF | Fluoroethene | 75-02-5 | 46.04 | −72.2 |
| C2H3F3 | CF3CH3 | 1,1,1-Trifluoroethane | 420-46-2 | 84.04 | −47.3 |
| C2H3F3O | F3COCH3 | Ether, methyl trifluoromethyl | 421-14-7 | 100.04 | −24.0 |
| C2H4 | H2CCH2 | Ethene | 74-85-1 | 28.05 | −103.7 |
| C2H4F2 | CHF2CH3 | 1,1-Difluoroethane | 75-37-6 | 66.05 | −24.0 |
| C2H5F | CH3CH2F | Fluoroethane | 353-36-6 | 48.06 | −37.7 |

TABLE 1-continued

| Dielectric Compound | Structure | Name | CAS | MW | MY BP(° C.) |
|---|---|---|---|---|---|
| C2H6 | CH3CH3 | Ethane | 74-84-0 | 30.07 | −88.6 |
| C2H6BF | (CH3)2BF | fluoro-dimethyl-borane | 353-46-8 | 59.88 | −44.0 |
| C2H6F4OSi2 | CH3SiF2OSiF2CH3 | Disiloxane, 1,1,3,3-tetrafluoro-1,3-dimethyl- | 63089-45-2 | 178.23 | −39.0 |
| C2HF3 | CF2═CFH | Trifluoroethene | 359-11-5 | 82.02 | −51.0 |
| C2HF3O | CF3C(O)H | trifluoroacetaldehyde//Trifluor-acetaldehyd | 75-90-1 | 98.02 | −21.0 |
| C2HF5 | CF3CF2H | Pentafluoroethane | 354-33-6 | 120.02 | −48.1 |
| C2HF5O | CF3OCHF2 | Difluoromethyl trifluoromethyl ether | 3822-68-2 | 136.02 | −35.3 |
| C3BiF9 | Bi(CF3)3 | Tris(trifluoromethyl)bismuth | 5863-80-9 | 416.00 | −55.0 |
| C3F4 | F2C═C═CF2 | tetrafluoropropadiene//tetrafluoro-allene//1,1,3,3-tetrafluoro-1,2-propadiene | 461-68-7 | 112.03 | −38.0 |
| C3F4 | ═CFCF2CF═ | tetrafluorocyclopropene | 19721-29-0 | 112.03 | −20.0 |
| C3F5IO | CF3CF2C(O)I | Perfluoropropionyliodid | 137741-03-8 | 273.93 | −27.0 |
| C3F5N | C2F5CN | pentafluoropropionitrile//pentafluoropropiononitrile | 422-04-8 | 145.03 | −35.0 |
| C3F6 | cyclo —CF2CF2CF2— | hexafluoro-cyclopropane//Hexafluor-cyclopropan//freon-#C!216 | 931-91-9 | 150.02 | −33.0 |
| C3F6 | CF3CF═CF2 | Hexafluoropropylene | 116-15-4 | 150.02 | −29.6 |
| C3F6O2 | cyclo-CF2—O—CF2—CF2—O— | hexafluoro-[1,3]dioxolane | 21297-65-4 | 182.02 | −22.1 |
| C3F8 | CF3CF2CF3 | Octafluoropropane | 76-19-7 | 188.02 | −36.7 |
| C3F8O | CF3CF2OCF3 | Perfluormethylethylether | 665-16-7 | 204.02 | −20.0 |
| C3H2F2 | F2CCCH2 | 1,1-difluoro-propadiene//allenylidene difluoride//1,1-difluoro-allene | 430-64-8 | 76.05 | −21.0 |
| C3H2F4 | H2CCFCF3 | 2,3,3,3-tetrafluoro-propene//HFO-1234yf | 754-12-1 | 114.04 | −28.3 |
| C3H2F4 | CHF═CHCF3 | trans HFO-1234ze | | 114.04 | −19.0 |
| C3H3F3 | CH2═CHCF3 | 3,3,3-Trifluoropropene | 677-21-4 | 96.05 | −25.0 |
| C3H4 | c-(CH═CH—CH2) | cyclopropene | 2781-85-3 | 40.06 | −36.0 |
| C3H4 | H2CCCH2 | Allene | 463-49-0 | 40.06 | −34.5 |
| C3H4F2 | CH3CH═CF2 | 1,1-difluoro-propene//propenylidene difluoride//1,1-Difluor-propen | 430-63-7 | 78.06 | −29.0 |
| C3H4O | | methylketene | 6004-44-0 | 56.06 | −23.0 |
| C3H5F | CH2CFCH3 | 2-fluoropropene | 1184-60-7 | 60.07 | −24.0 |
| C3H6 | CH2CHCH3 | 1-Propene | 115-07-1 | 42.08 | −47.7 |
| C3H7NO2 | | DL-2-aminopropanoic acid | 302-72-7 | 89.09 | −50.2 |
| C3HF3 | F3CCCH | 3,3,3-trifluoro-propyne//3,3,3-Trifluor-propin//trifluoromethyl-ethyne//3,3,3-trifluoro-1-propyne | 661-54-1 | 94.04 | −48.0 |
| C3HF5 | CF3CH═CF2 | 1,1,3,3,3-pentafluoro-propene//1,1,3,3,3-Pentafluor-propen | 690-27-7 | 132.03 | −21.0 |
| C3HF5 | CF3—CF—CFH | 1,2,3,3,3-pentafluoro-propene | 2252-83-7 | 132.03 | −20.0 |
| C4F6 | CF3CCCF3 | 1,1,1,4,4,4-hexafluoro-2-butyne | 692-50-2 | 162.03 | −24.6 |
| C4H2F4O2 | CF2HC(O)C (O)CF2H | 1,1,4,4-tetrafluoro-butane-2,3-dione | | 158.05 | −81.0 |
| C4H6N2O2 | | | | 114.10 | −33.0 |
| CClF3O | F3C—O—Cl | Trifluormethylhypochlorit | 22082-78-6 | 120.46 | −47.0 |
| CClF3O | ClF2C—OF | Chlor-difluor-methyl-hypofluorit | 20614-17-9 | 120.46 | −25.0 |
| CClF4N | CF3NFCl | N-Chlor-N-fluor-trifluormethylamin (germ.) | 13880-72-3 | 137.46 | −32.8 |
| CClF4N | ClCF2—NF2 | Chlordifluordifluoraminomethan | 13880-71-2 | 137.46 | −28.0 |
| CF2S | F2C═S | thiocarbonyl difluoride Thiocarbonyldifluorid (germ.) | 420-32-6 | 82.07 | −46.0 |
| CF2Se | F2C═Se | selenocarbonyl difluoride | 54393-39-4 | 128.97 | −28.0 |
| CF3I | CF3I | Trifluoroiodomethane | 2314-97-8 | 195.91 | −21.8 |
| CF3N | CF2—N—F | N-Fluor-difluormethanimin (germ.) | 338-66-9 | 83.01 | −101.0 |
| CF3NO | CF3N═O | trifluoro-nitroso-methane//Trifluor-nitroso-methan | 334-99-6 | 99.01 | −86.0 |

TABLE 1-continued

| Dielectric Compound | Structure | Name | CAS | MW | MY BP(° C.) |
|---|---|---|---|---|---|
| CF3NO | FC(O)NF2 | difluoro-carbamoyl fluoride | 2368-32-3 | 99.01 | −52.0 |
| CF3NO2 | CF3NO2 | trifluoro-nitro-methane//Trifluor-nitro-methan//fluoropicrin | 335-02-4 | 115.01 | −33.6 |
| CF4 | CF4 | Tetrafluoromethane | 75-73-0 | 88.00 | −128.1 |
| CF4N2 | NF2CF═NF | Tetrafluorformamidin (germ.) | 14362-70-0 | 116.02 | −30.0 |
| CF4N2O | (NF2)2CO | tetrafluorourea | 10256-92-5 | 132.02 | −20.0 |
| CF4O | | hypofluorous acid trifluoromethylester// Hypofluorigsaeure-trifluormethylester//trifluoromethyl hypofluorite | | 104.00 | −95.0 |
| CF4O2S | CF3SO2F | trifluoromethanesulfonyl fluoride | 335-05-7 | 152.07 | −21.7 |
| CF5N | CF3NF2 | N,N-Difluor-trifluormethylamin (germ.) | 335-01-3 | 121.01 | −75.0 |
| CF5NO | CF3ONF2 | Trifluormethyloxydifluoramin | 4217-93-0 | 137.01 | −59.8 |
| CF5NO2 | F2NOCF2OF | (Difluoraminoxy)difluormethyl-hypofluorit | 36781-60-9 | 153.01 | −29.0 |
| CF5NS | SF5CN | sulfurcyanide pentafluoride Schwefelcyanid-pentafluorid (germ.) | 1512-13-6 | 153.08 | −25.0 |
| CF5P | CF3PF2 | difluoro-trifluoromethyl-phosphine | 1112-04-5 | 137.98 | −43.0 |
| CF6N2 | F2NCF2NF2 | Hexafluormethandiamin | 4394-93-8 | 154.01 | −37.0 |
| CF6Si | CF3SiF3 | perfluoro methyl silane Perfluormethylsilan (germ.) | 335-06-8 | 154.09 | −42.0 |
| CF7P | CF3PF4 | Trifluormethyl-tetrafluorphosphoran (germ.) | 1184-81-2 | 175.97 | −35.0 |
| CH2F2 | CH2F2 | Difluoromethane | 75-10-5 | 52.02 | −51.7 |
| CH2FI | CH2FI | Fluoroiodomethane | 373-53-5 | 159.93 | −53.8 |
| CH3F | | fluoromethane//methyl fluoride//Fluormethan// freon-41 | 593-53-3 | 34.03 | −78.3 |
| CH3F3Si | CF3SiH3 | trifluoromethyl-silane" CF3SiH3 | 10112-11-5 | 100.12 | −38.3 |
| CH3F3Si | CH3SiF3 | methyltrifluorosilane | 373-74-0 | 100.12 | −30.0 |
| CH4F2Si | F2HSiCH3 | difluoro-methyl-silane | 420-34-8 | 82.12 | −35.6 |
| CH5FSi | CH3SiH2F | fluoro-methyl-silane | 753-44-6 | 64.13 | −44.0 |
| CH6Ge | H3GeCH3 | methylgermane | 1449-65-6 | 90.65 | −23.0 |
| CHF2N | F2C═NH | Difluorformimin | 2712-98-3 | 65.02 | −22.0 |
| CHF3 | CHF3 | Trifluoromethane | 75-46-7 | 70.01 | −82.1 |
| CHF3S | CF3SH | trifluoromethane thiol Trifluormethanthiol (germ.) | 1493-15-8 | 102.08 | −36.7 |
| CHF4N | CF2H—NF2 | N,N,1,1-Tetrafluormethylamin | 24708-53-0 | 103.02 | −43.0 |
| Cl2F2Si | SiF2Cl2 | difluoro dichlorosilane Difluordichlorsilan (germ.) | 18356-71-3 | 136.99 | −31.8 |
| ClF2HSi | SiF2HCl | difluoro chlorosilane Difluorchlorsilan (germ.) | 80003-43-6 | 102.56 | −50.0 |
| ClF2P | PF2Cl | Phosphorus chloride difluoride | 14335-40-1 | 104.42 | −47.3 |
| ClF3Si | SiClF3 | Chlorotrifluorosilane | 14049-36-6 | 120.53 | −70.2 |
| ClH | HCl | Hydrogen chloride | 7647-01-0 | 36.46 | −85.0 |
| ClH3Si | SiH3Cl | Chlorosilane | 13465-78-6 | 66.56 | −30.3 |
| CO | CO | Carbon monoxide | 630-08-0 | 28.01 | −191.5 |
| CO2 | CO2 | Carbon dioxide | 124-38-9 | 44.01 | −78.4 |
| COS | OCS | Carbonyl sulfide | 463-58-1 | 60.07 | −50.3 |
| F2HN | NHF2 | Difluoramine | 10405-27-3 | 53.01 | −23.2 |
| F2N2 | FNNF | trans-Difluorodiazine | 13776-62-0 | 66.01 | −111.5 |
| F2N2 | FNNF | cis-Difluorodiazine | 13812-43-6 | 66.01 | −105.8 |
| F2OS | F2SO | Thionyl fluoride | 7783-42-8 | 86.06 | −43.8 |
| F3HSi | SiHF3 | Trifluorosilane | 13465-71-9 | 86.09 | −95.2 |
| F3N | NF3 | Nitrogen trifluoride | 7783-54-2 | 71.00 | −129.1 |
| F3NO | NOF3 | Trifluoramine oxide | 13847-65-9 | 87.00 | −87.5 |
| F3NS | NSF3 | thiazyl trifluoride | 15930-75-3 | 103.07 | −27.1 |
| F3P | PF3 | Phosphorus trifluoride | 7783-55-3 | 87.97 | −101.5 |
| F4Ge | GeF4 | Germanium(IV) fluoride | 7783-58-6 | 148.58 | −36.5 |
| F4Si | SiF4 | Tetrafuorosilane | 7783-61-1 | 104.08 | −86.0 |
| F5P | PF5 | Phosphorus pentafluoride | 7647-19-0 | 125.97 | −84.5 |
| F6Se | SeF6 | Selenium hexafluoride | 7783-79-1 | 192.95 | −46.5 |
| F6Te | TeF6 | Tellurium hexafluoride | 7783-80-4 | 241.59 | −38.8 |
| FH3Si | SiH3F | fluorosilane | 13537-33-2 | 50.11 | −98.0 |
| FNO | | Nitrosyl fluoride | 7789-25-5 | 49.00 | −59.9 |
| FNO3 | | Fluorine nitrate | 7789-26-6 | 81.00 | −46.2 |

TABLE 1-continued

| Dielectric Compound | Structure | Name | CAS | MW | MY BP(° C.) |
|---|---|---|---|---|---|
| H2S | H2S | Hydrogen sulfide | 7783-06-4 | 34.08 | −59.5 |
| H3N | NH3 | Ammonia | 7664-41-7 | 17.03 | −33.3 |
| He | He | Helium | 7440-59-7 | 4.00 | −268.9 |
| HI | HI | Hydrogen iodide | 10034-85-2 | 127.91 | −35.6 |
| Kr | Kr | Krypton | 7439-90-9 | 83.80 | −153.4 |
| N2 | N2 | Nitrogen | 7727-37-9 | 28.01 | −195.8 |
| N2O | NNO | dinitrogen oxide | 10024-97-2 | 44.01 | −88.5 |
| Ne | Ne | Neon | 7440-01-9 | 20.18 | −246.1 |
| NO | NO | Nitrogen oxide | 10102-43-9 | 30.01 | −151.8 |
| Xe | Xe | Xenon | 7440-63-3 | 131.29 | −108.1 |

15

The preferred dielectric compounds are selected from the group consisting of those set forth in Table 2 below:

TABLE 2

| Dielectric Compound | Structure | Name | CAS | MW | MY BP(° C.) |
|---|---|---|---|---|---|
| Ar | Ar | Argon | 7440-37-1 | 39.95 | −185.9 |
| BF3 | BF3 | Trifluoroborane | 7637-07-2 | 67.81 | −101.2 |
| BrH | HBr | Hydrogen bromide | 10035-10-6 | 80.91 | −66.7 |
| C2BrF5 | CF3CF2Br | Bromopentafluoroethane | 354-55-2 | 198.92 | −21.0 |
| C2ClF3 | CFCl═CF2 | Chlorotrifluoroethene | 79-38-9 | 116.47 | −28.4 |
| C2F3N | CF3CN | Trifluoroacetonitrile | 353-85-5 | 95.02 | −68.8 |
| C2F3NO | (CF3)NCO | trifluoromethyl isocyanate | 460-49-1 | 111.02 | −36.0 |
| C2F4S | CF3C(S)F | trifluoromethyl thiocarbonyl fluoride Trifluormethylthiocarbonylfluorid (germ.) | | 132.08 | −21.0 |
| C2F5NO | CF3CF2NO | pentafluoro-nitroso-ethane//Pentafluor-nitroso-aethan | 354-72-3 | 149.02 | −45.7 |
| C2F5NO | CF3C(O)NF2 | (trifluoromethyl-carbonyl)-difluoro-amine | 32822-49-4 | 149.02 | −21.1 |
| C2F6 | CF3CF3 | Hexafluoroethane | 76-16-4 | 138.01 | −78.2 |
| C2F6NO | CF3N(O)CF3 | Bis-trifluormethyl-nitroxid | 2154-71-4 | 168.02 | −20.0 |
| C2F6O | CF3OCF3 | bis-trifluoromethyl ether | 1479-49-8 | 154.01 | −59.0 |
| C2F6Te | (CF3)2Te | bis(trifluoromethyl)tellurium | 55642-42-7 | 265.61 | −98.0 |
| C2F6Te2 | CF3TeTeCF3 | bis(trifluoromethyl) ditelluride | 1718-20-3 | 393.21 | −53.0 |
| C2F7N | CF3CF2NF2 | N,N-Difluor-pentafluoraethylamin (germ.) | 354-80-3 | 171.02 | −38.0 |
| C2F7N | (CF3)2NF | N-Fluor-bis(trifluormethyl)-amin (germ.) | 359-62-6 | 171.02 | −37.0 |
| C2F7NO | CF3NFOCF3 | N-Fluor-N-trifluormethoxy-perfluormethylamin (germ.) | 4217-92-9 | 187.02 | −25.0 |
| C2FNO | FC(O)CN | fluoroformyl cyanide | 683-55-6 | 73.03 | −21.0 |
| C2H2ClF | CH2CFCl | 1-chloro-1-fluoro-ethene//1-Chlor-1-fluor-aethen//1-chloro-1-fluoroethylene | 2317-91-1 | 80.49 | −25.5 |
| C2H2F2 | CF2═CH2 | 1,1-Difluoroethene | 75-38-7 | 64.03 | −85.7 |
| C2H2F2 | CHF═CHF | #trans!-1,2-difluoro-ethene//#trans!-vinylene difluoride//(E)-1,2-difluoroethylene//(E)-1,2-difluoro-ethene//#trans!-vinylene fluoride | 1630-78-0 | 64.03 | −53.1 |
| C2H2F2 | FHC═CHF | 1,2-difluoro-ethene//#cis!-vinylene difluoride//1,2-Difluor-aethen//vinylene fluoride | 1691-13-0 | 64.03 | −28.0 |
| C2H2F2 | CHF═CHF | #cis!-1,2-difluoro-ethene//#cis!-vinylene difluoride//(Z)-1,2-difluoroethylene//(Z)-1,2-difluoro-ethene//#cis!-vinylene fluoride | 1630-77-9 | 64.03 | −26.0 |
| C2H2F4 | CF3CH2F | 1,1,1,2-Tetrafluoroethane | 811-97-2 | 102.03 | −26.1 |
| C2H2F4 | CF2HCF2H | 1,1,2,2-Tetrafluoroethane | 359-35-3 | 102.03 | −23.0 |
| C2H3F | CH2═CHF | Fluoroethene | 75-02-5 | 46.04 | −72.2 |
| C2H3F3 | CF3CH3 | 1,1,1-Trifluoroethane | 420-46-2 | 84.04 | −47.3 |

TABLE 2-continued

| Dielectric Compound | Structure | Name | CAS | MW | MY BP(° C.) |
|---|---|---|---|---|---|
| C2H3F3O | F3COCH3 | Ether, methyl trifluoromethyl | 421-14-7 | 100.04 | −24.0 |
| C2H4 | H2CCH2 | Ethene | 74-85-1 | 28.05 | −103.7 |
| C2H4F2 | CHF2CH3 | 1,1-Difluoroethane | 75-37-6 | 66.05 | −24.0 |
| C2H5F | CH3CH2F | Fluoroethane | 353-36-6 | 48.06 | −37.7 |
| C2H6 | CH3CH3 | Ethane | 74-84-0 | 30.07 | −88.6 |
| C2H6BF | (CH3)2BF | fluoro-dimethyl-borane | 353-46-8 | 59.88 | −44.0 |
| C2H6F4OSi2 | CH3SiF2OSiF2CH3 | Disiloxane, 1,1,3,3-tetrafluoro-1,3-dimethyl- | 63089-45-2 | 178.23 | −39.0 |
| C2HF3 | CF2═CFH | Trifluoroethene | 359-11-5 | 82.02 | −51.0 |
| C2HF3O | CF3C(O)H | trifluoroacetaldehyde//Trifluor-acetaldehyd | 75-90-1 | 98.02 | −21.0 |
| C2HF5 | CF3CF2H | Pentafluoroethane | 354-33-6 | 120.02 | −48.1 |
| C2HF5O | CF3OCHF2 | Difluoromethyl trifluoromethyl ether | 3822-68-2 | 136.02 | −35.3 |
| C3BiF9 | Bi(CF3)3 | Tris(trifluoromethyl)bismuth | 5863-80-9 | 416.00 | −55.0 |
| C3F4 | F2C═C═CF2 | tetrafluoropropadiene//tetrafluoro-allene//1,1,3,3-tetrafluoro-1,2-propadiene | 461-68-7 | 112.03 | −38.0 |
| C3F4 | ═CFCF2CF═ | tetrafluorocyclopropene | 19721-29-0 | 112.03 | −20.0 |
| C3F5IO | CF3CF2C(O)I | Perfluoropropionyliodid | 137741-03-8 | 273.93 | −27.0 |
| C3F5N | C2F5CN | pentafluoropropionitrile//pentafluoropropiononitrile | 422-04-8 | 145.03 | −35.0 |
| C3F6 | cyclo —CF2CF2CF2— | hexafluorocyclopropane//Hexafluorcyclopropan//freon-#C!216 | 931-91-9 | 150.02 | −33.0 |
| C3F6 | CF3CF═CF2 | Hexafluoropropylene | 116-15-4 | 150.02 | −29.6 |
| C3F6O2 | cyclo-CF2—O—CF2—CF2—O— | hexafluoro-[1,3]dioxolane | 21297-65-4 | 182.02 | −22.1 |
| C3F8 | CF3CF2CF3 | Octafluoropropane | 76-19-7 | 188.02 | −36.7 |
| C3F8O | CF3CF2OCF3 | Perfluormethylethylether | 665-16-7 | 204.02 | −20.0 |
| C3H2F2 | F2CCCH2 | 1,1-difluoro-propadiene//allenylidene difluoride//1,1-difluoro-allene | 430-64-8 | 76.05 | −21.0 |
| C3H2F4 | H2CCFCF3 | 2,3,3,3-tetrafluoro-propene//HFO-1234yf | 754-12-1 | 114.04 | −28.3 |
| C3H2F4 | CHF═CHCF3 | trans HFO-1234ze | | 114.04 | −19.0 |
| C3H3F3 | CH2═CHCF3 | 3,3,3-Trifluoropropene | 677-21-4 | 96.05 | −25.0 |
| C3H4 | c-(CH═CH—CH2) | cyclopropene | 2781-85-3 | 40.06 | −36.0 |
| C3H4 | H2CCCH2 | Allene | 463-49-0 | 40.06 | −34.5 |
| C3H4F2 | CH3CH═CF2 | 1,1-difluoropropene//propenylidene difluoride//1,1-Difluorpropen | 430-63-7 | 78.06 | −29.0 |
| C3H4O | | methylketene | 6004-44-0 | 56.06 | −23.0 |
| C3H5F | CH2CFCH3 | 2-fluoropropene | 1184-60-7 | 60.07 | −24.0 |
| C3H6 | CH2CHCH3 | 1-Propene | 115-07-1 | 42.08 | −47.7 |
| C3H7NO2 | | DL-2-aminopropanoic acid | 302-72-7 | 89.09 | −50.2 |
| C3HF3 | F3CCCH | 3,3,3-trifluoro-propyne//3,3,3-Trifluor-propin//trifluoromethyl-ethyne//3,3,3-trifluoro-1-propyne | 661-54-1 | 94.04 | −48.0 |
| C3HF5 | CF3CH═CF2 | 1,1,3,3,3-pentafluoro-propene//1,1,3,3,3-Pentafluor-propen | 690-27-7 | 132.03 | −21.0 |
| C3HF5 | CF3—CF—CFH | 1,2,3,3,3-pentafluoro-propene | 2252-83-7 | 132.03 | −20.0 |
| C4F6 | CF3CCCF3 | 1,1,1,4,4,4-hexafluoro-2-butyne | 692-50-2 | 162.03 | −24.6 |
| C4H2F4O2 | CF2HC(O)C(O)CF2H | 1,1,4,4-tetrafluoro-butane-2,3-dione | | 158.05 | −81.0 |
| C4H6N2O2 | | | | 114.10 | −33.0 |
| CClF3O | F3C—O—Cl | Trifluormethylhypochlorit | 22082-78-6 | 120.46 | −47.0 |
| CClF3O | ClF2C—OF | Chlor-difluor-methyl-hypofluorit | 20614-17-9 | 120.46 | −25.0 |
| CClF4N | CF3NFCl | N-Chlor-N-fluor-trifluormethylamin (germ.) | 13880-72-3 | 137.46 | −32.8 |
| CClF4N | ClCF2—NF2 | Chlordifluordifluoraminomethan | 13880-71-2 | 137.46 | −28.0 |
| CF2S | F2C═S | thiocarbonyl difluoride Thiocarbonyldifluorid (germ.) | 420-32-6 | 82.07 | −46.0 |
| CF2Se | F2C═Se | selenocarbonyl difluoride | 54393-39-4 | 128.97 | −28.0 |
| CF3I | CF3I | Trifluoroiodomethane | 2314-97-8 | 195.91 | −21.8 |
| CF3N | CF2—N—F | N-Fluor-difluormethanimin (germ.) | 338-66-9 | 83.01 | −101.0 |

TABLE 2-continued

| Dielectric Compound | Structure | Name | CAS | MW | MY BP(° C.) |
|---|---|---|---|---|---|
| CF3NO | CF3N═O | trifluoro-nitroso-methane//Trifluor-nitroso-methan | 334-99-6 | 99.01 | −86.0 |
| CF3NO | FC(O)NF2 | difluoro-carbamoyl fluoride | 2368-32-3 | 99.01 | −52.0 |
| CF3NO2 | CF3NO2 | trifluoro-nitro-methane//Trifluor-nitro-methan//fluoropicrin | 335-02-4 | 115.01 | −33.6 |
| CF4 | CF4 | Tetrafluoromethane | 75-73-0 | 88.00 | −128.1 |
| CF4N2 | NF2CF═NF | Tetrafluorformamidin (germ.) | 14362-70-0 | 116.02 | −30.0 |
| CF4N2O | (NF2)2CO | tetrafluorourea | 10256-92-5 | 132.02 | −20.0 |
| CF4O | | hypofluorous acid trifluoromethyl ester//Hypofluorigsaeure-trifluormethylester//trifluoromethylhypofluorite | | 104.00 | −95.0 |
| CF4O2S | CF3SO2F | trifluoromethanesulfonyl fluoride | 335-05-7 | 152.07 | −21.7 |
| CF5N | CF3NF2 | N,N-Difluor-trifluormethylamin (germ.) | 335-01-3 | 121.01 | −75.0 |
| CF5NO | CF3ONF2 | Trifluormethyloxydifluoramin | 4217-93-0 | 137.01 | −59.8 |
| CF5NO2 | F2NOCF2OF | (Difluoraminoxy)difluormethyl-hypofluorit | 36781-60-9 | 153.01 | −29.0 |
| CF5NS | SF5CN | sulfurcyanide pentafluoride Schwefelcyanid-pentafluorid (germ.) | 1512-13-6 | 153.08 | −25.0 |
| CF5P | CF3PF2 | difluoro-trifluoromethyl-phosphine | 1112-04-5 | 137.98 | −43.0 |
| CF6N2 | F2NCF2NF2 | Hexafluormethandiamin | 4394-93-8 | 154.01 | −37.0 |
| CF6Si | CF3SiF3 | perfluoro methyl silane Perfluormethylsilan (germ.) | 335-06-8 | 154.09 | −42.0 |
| CF7P | CF3PF4 | Trifluormethyl-tetrafluorphosphoran (germ.) | 1184-81-2 | 175.97 | −35.0 |
| CH2F2 | CH2F2 | Difluoromethane | 75-10-5 | 52.02 | −51.7 |
| CH2FI | CH2FI | Fluoroiodomethane | 373-53-5 | 159.93 | −53.8 |
| CH3F | | fluoromethane//methyl fluoride//Fluormethan//freon-41 | 593-53-3 | 34.03 | −78.3 |
| CH3F3Si | CF3SiH3 | trifluoromethyl-silane" CF3SiH3 | 10112-11-5 | 100.12 | −38.3 |
| CH3F3Si | CH3SiF3 | methyltrifluorosilane | 373-74-0 | 100.12 | −30.0 |
| CH4F2Si | F2HSiCH3 | difluoro-methyl-silane | 420-34-8 | 82.12 | −35.6 |
| CH5FSi | CH3SiH2F | fluoro-methyl-silane | 753-44-6 | 64.13 | −44.0 |
| CH6Ge | H3GeCH3 | methylgermane | 1449-65-6 | 90.65 | −23.0 |
| CHF2N | F2C═NH | Difluorformimin | 2712-98-3 | 65.02 | −22.0 |
| CHF3 | CHF3 | Trifluoromethane | 75-46-7 | 70.01 | −82.1 |
| CHF3S | CF3SH | trifluoromethane thiol Trifluormethanthiol (germ.) | 1493-15-8 | 102.08 | −36.7 |
| CHF4N | CF2H—NF2 | N,N,1,1-Tetrafluormethylamin | 24708-53-0 | 103.02 | −43.0 |
| Cl2F2Si | SiF2Cl2 | difluoro dichlorosilane Difluordichlorsilan (germ.) | 18356-71-3 | 136.99 | −31.8 |
| ClF2HSi | SiF2HCl | difluoro chlorosilane Difluorchlorsilan (germ.) | 80003-43-6 | 102.56 | −50.0 |
| ClF2P | PF2Cl | Phosphorus chloride difluoride | 14335-40-1 | 104.42 | −47.3 |
| ClF3Si | SiClF3 | Chlorotrifluorosilane | 14049-36-6 | 120.53 | −70.2 |
| ClH | HCl | Hydrogen chloride | 7647-01-0 | 36.46 | −85.0 |
| ClH3Si | SiH3Cl | Chlorosilane | 13465-78-6 | 66.56 | −30.3 |
| CO | CO | Carbon monoxide | 630-08-0 | 28.01 | −191.5 |
| CO2 | CO2 | Carbon dioxide | 124-38-9 | 44.01 | −78.4 |
| COS | OCS | Carbonyl sulfide | 463-58-1 | 60.07 | −50.3 |
| F2HN | NHF2 | Difluoramine | 10405-27-3 | 53.01 | −23.2 |
| F2N2 | FNNF | trans-Difluorodiazine | 13776-62-0 | 66.01 | −111.5 |
| F2N2 | FNNF | cis-Difluorodiazine | 13812-43-6 | 66.01 | −105.8 |
| F2OS | F2SO | Thionyl fluoride | 7783-42-8 | 86.06 | −43.8 |
| F3HSi | SiHF3 | Trifluorosilane | 13465-71-9 | 86.09 | −95.2 |
| F3N | NF3 | Nitrogen trifluoride | 7783-54-2 | 71.00 | −129.1 |
| F3NO | NOF3 | Trifluoramine oxide | 13847-65-9 | 87.00 | −87.5 |
| F3NS | NSF3 | thiazyl trifluoride | 15930-75-3 | 103.07 | −27.1 |
| F3P | PF3 | Phosphorus trifluoride | 7783-55-3 | 87.97 | −101.5 |
| F4Ge | GeF4 | Germanium(IV) fluoride | 7783-58-6 | 148.58 | −36.5 |
| F4Si | SiF4 | Tetrafluorosilane | 7783-61-1 | 104.08 | −86.0 |
| F5P | PF5 | Phosphorus pentafluoride | 7647-19-0 | 125.97 | −84.5 |
| F6Se | SeF6 | Selenium hexafluoride | 7783-79-1 | 192.95 | −46.5 |
| F6Te | TeF6 | Tellurium hexafluoride | 7783-80-4 | 241.59 | −38.8 |
| FH3Si | SiH3F | fluorosilane | 13537-33-2 | 50.11 | −98.0 |

TABLE 2-continued

| Dielectric Compound | Structure | Name | CAS | MW | MY BP(° C.) |
|---|---|---|---|---|---|
| FNO | | Nitrosyl fluoride | 7789-25-5 | 49.00 | −59.9 |
| FNO3 | | Fluorine nitrate | 7789-26-6 | 81.00 | −46.2 |
| H2S | H2S | Hydrogen sulfide | 7783-06-4 | 34.08 | −59.5 |
| H3N | NH3 | Ammonia | 7664-41-7 | 17.03 | −33.3 |
| He | He | Helium | 7440-59-7 | 4.00 | −268.9 |
| HI | HI | Hydrogen iodide | 10034-85-2 | 127.91 | −35.6 |
| Kr | Kr | Krypton | 7439-90-9 | 83.80 | −153.4 |
| N2 | N2 | Nitrogen | 7727-37-9 | 28.01 | −195.8 |
| N2O | NON | Nitrous oxide | 10024-97-2 | 44.01 | −88.5 |
| Ne | Ne | Neon | 7440-01-9 | 20.18 | −246.1 |
| NO | NO | Nitrogen oxide | 10102-43-9 | 30.01 | −151.8 |
| Xe | Xe | Xenon | 7440-63-3 | 131.29 | −108.1 |

The aforementioned dielectric compounds may be used in pure form, but can also be used as part of an azeotrope, or a mixture with an appropriate second gas, i.e., nitrogen, $CO_2$ or $N_2O$.

Particularly preferred non-electrical properties for dielectric gases according to the present disclosure, include:

Non-liquefying, e.g., $T_{boil}$ less than −20° C.

Chemically stable—decomposition temperature must be higher than hot spot temperature in equipment, e.g., $T_{dec}$=200° C., and gas should not decompose in partial discharge spark (approximately 1000° K)

Low environmental impact, i.e., little to no destruction of ozone layer ODP=0; and low global warming impact GWP less than $SF_6$ Acceptably low toxicity of gas and discharge byproducts Electrical equipment property requirements for dielectric gases according to the present disclosure, include:

Insulation specific criteria include a critical field of $E_{cr}$, and no conducting decomposition products should be generated by discharge Switching specific criteria include high critical field of $E_{cr}$, arcing stability, i.e., a gas must recombine to original molecular structure after being decomposed in switching arc (Gibbs free energy of reaction is<0)

Specific thermal interruption performance, i.e., must be able to interrupt current flow at ac current zero Arc erosion product from equipment and gas must not form conduction deposits Low velocity of sound

EXAMPLE 1

Measurements of the dielectric strength of potential alternatives were determined using ASTM D2477 or obtained from literature. These measurements were performed at 1 atmosphere pressure across a 0.1 inch gap and at ambient temperature.

In the intended applications, the gas will not be at 1 atmosphere pressure but at a higher pressure. In this example 5 atmospheres pressure is used as a maximum pressure. If the gas liquefies at a lower pressure than that pressure was used. These gases have higher dielectric strengths and break down voltages than air. Using 5 atmospheres (73.5 psia) pressure as the upper pressure (rating of the equipment).

| Gas | Dielectric strength kV/0.1 inch gap | Pressure (psia) | Breakdown voltage at maximum pressure (kV/0.1 inch gap) |
|---|---|---|---|
| Air | 4.75 | 73.5 | 23.75 |
| R143a | 5.8 | 73.5 | 29 |
| R152a | 5.9 | 73.5 | 29.5 |
| R125 | 6.4 | 73.5 | 32 |
| R134a | 6.6 | 73.5 | 33 |
| R22 | 7.2 | 73.5 | 39.9 |
| R124 | 10.4 | 55.5 | 39.3 |
| SF6 | 14.0 | 73.5 | 70 |
| C318 | 16.0 | 45.3 | 49.3 |
| R115 | 16.0 | 73.6 | 80 |
| R114 | 17.0 | 31.1 | 36 |

EXAMPLE 2

The dielectric strength of additional gases is measure at 1 atmosphere and at the maximum system pressure. Their breakdown voltages are found to be greater then air, which allows smaller gaps and therefore smaller equipment then would be need if air was used. Here the measurements were performed on CTFE (Chlorotrifluoroethylene), HCl (hydrogen chloride) and SiF4 (silicon tetrafluoride).

Having described the invention in detail by reference to the preferred embodiments and specific examples thereof, it will be apparent that modifications and variations are possible without departing from the spirit and scope of the disclosure and claims.

What is claimed is:

1. An insulation gas in electrical equipment, the insulation gas consisting of phosphorous pentafluoride and at least one gas selected from the group consisting of nitrogen, $CO_2$, and $N_2O$.

2. The insulation-gas according to claim 1, wherein said electrical equipment is selected from the group consisting of current-interruption equipment, gas-insulated transmission lines, gas-insulated transformers, and gas-insulated substations.

* * * * *